US005472113A

United States Patent [19]

Shaw

[11] Patent Number: 5,472,113

[45] Date of Patent: Dec. 5, 1995

[54] AUTOMATIC PILL DISPENSING APPARATUS

[76] Inventor: Thomas J. Shaw, 1510 Hillcrest, Little Elm, Tex. 75068

[21] Appl. No.: 178,926

[22] Filed: Jan. 7, 1994

Related U.S. Application Data

[63] Continuation of Ser. No. 260, Jan. 4, 1993.

[51] Int. Cl.[6] ..... G07F 11/00

[52] U.S. Cl. ..... 221/7; 221/15; 221/82

[58] Field of Search ..... 221/7, 15, 13, 221/9, 82, 86, 113, 120, 133

[56] References Cited

U.S. PATENT DOCUMENTS

| | | | |
|---|---|---|---|
| 3,815,780 | 6/1974 | Bauer | 221/15 |
| 3,911,856 | 10/1975 | Ewing | 116/121 |
| 3,985,264 | 10/1976 | Shaw et al. | 221/13 |
| 3,998,356 | 12/1976 | Christensen | 221/2 |
| 4,087,020 | 5/1978 | Krakauer | 221/197 |
| 4,207,992 | 6/1980 | Brown | 221/82 |
| 4,223,801 | 9/1980 | Carlson | 221/3 |
| 4,275,384 | 6/1981 | Hicks et al. | 340/309.4 |
| 4,360,125 | 11/1982 | Martindale et al. | 221/2 |
| 4,473,884 | 9/1984 | Behl | 364/479 |
| 4,572,403 | 2/1986 | Benaroya | 221/3 |
| 4,573,606 | 3/1986 | Lewis et al. | 221/3 |
| 4,674,651 | 6/1987 | Scidmore et al. | 221/15 |
| 4,695,954 | 9/1987 | Rose et al. | 364/413 |
| 4,809,877 | 3/1989 | Albright | 221/82 |
| 4,811,764 | 3/1989 | McLaughlin | 221/2 |
| 4,838,453 | 6/1989 | Luckstead | 221/2 |
| 4,953,745 | 9/1990 | Rowlett, Jr. | 221/7 |
| 5,077,462 | 12/1991 | Newell et al. | 364/479 |

FOREIGN PATENT DOCUMENTS

| | | | |
|---|---|---|---|
| 2178733 | 2/1987 | United Kingdom | 221/120 |

*Primary Examiner*—Kenneth Noland

*Attorney, Agent, or Firm*—Harry J. Watson; Harris, Tucker & Hardin

[57] ABSTRACT

An automatic pill dispensing apparatus is provided having a plurality of cartridges support in guide slots within a housing. The apparatus is integrated with a microprocessor operating according to an algorithm, which receives, stores and processes prescription schedule data. Each cartridge has a plurality of compartments disposed about its periphery for containing medication to be dispensed at proper intervals at a dispensing position. An alarm is sounded for the user when the cartridges are ready to be positioned for dispensing medication according to the prescription schedule. A dispense bar is manually actuated by the user to eject scheduled medication into a tray for user access. If the user fails to dispense scheduled medication, it is withheld to prevent double dosing at subsequent dispensing times. The plurality of cartridges enable filling by a pharmacist of independent multiple prescriptions. After the cabinet housing is loaded for use, the housing is locked to prevent access unless a security code is entered into the processor. A dislodging wire sweeps through each compartment as the dispense bar is depressed, thereby dislodging the medication from the compartment for user access.

22 Claims, 9 Drawing Sheets

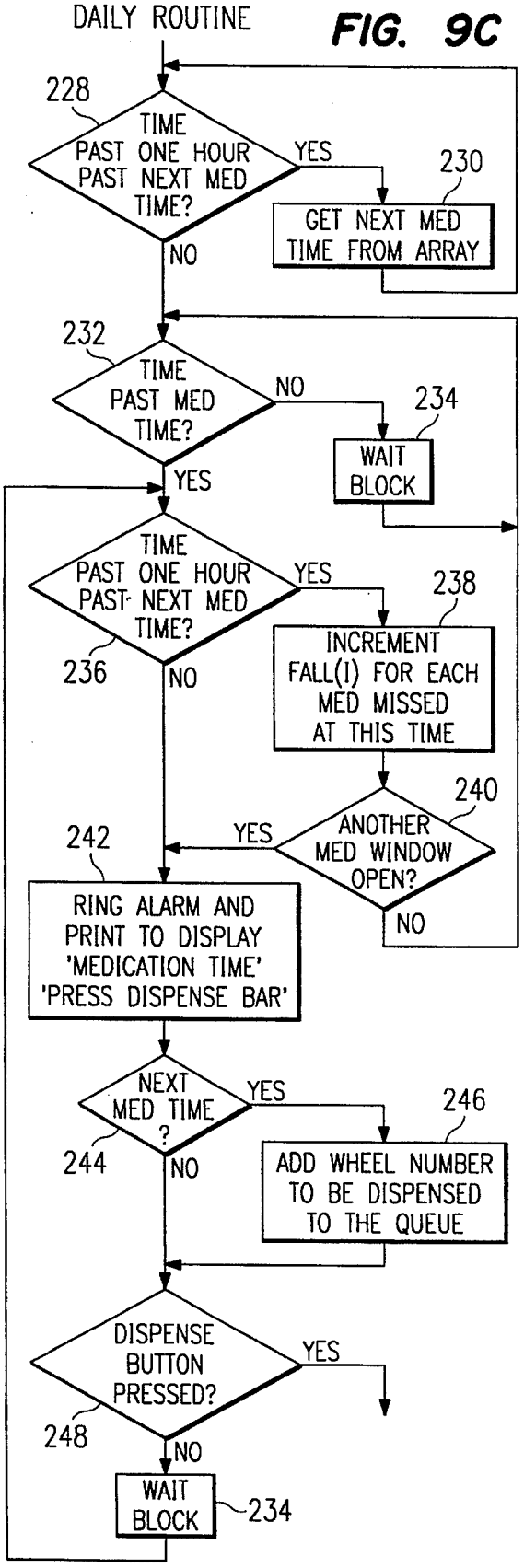
DAILY ROUTINE
FIG. 9C
228
TIME PAST ONE HOUR PAST NEXT MED TIME?
YES
230
GET NEXT MED TIME FROM ARRAY
NO
232
TIME PAST MED TIME?
NO
234
WAIT BLOCK
YES
TIME PAST ONE HOUR PAST NEXT MED TIME?
YES
238
INCREMENT FALL(I) FOR EACH MED MISSED AT THIS TIME
236
NO
240
ANOTHER MED WINDOW OPEN?
YES
242
NO
RING ALARM AND PRINT TO DISPLAY 'MEDICATION TIME' 'PRESS DISPENSE BAR'
NEXT MED TIME ?
YES
246
244
NO
ADD WHEEL NUMBER TO BE DISPENSED TO THE QUEUE
DISPENSE BUTTON PRESSED?
YES
248
NO
WAIT BLOCK
234

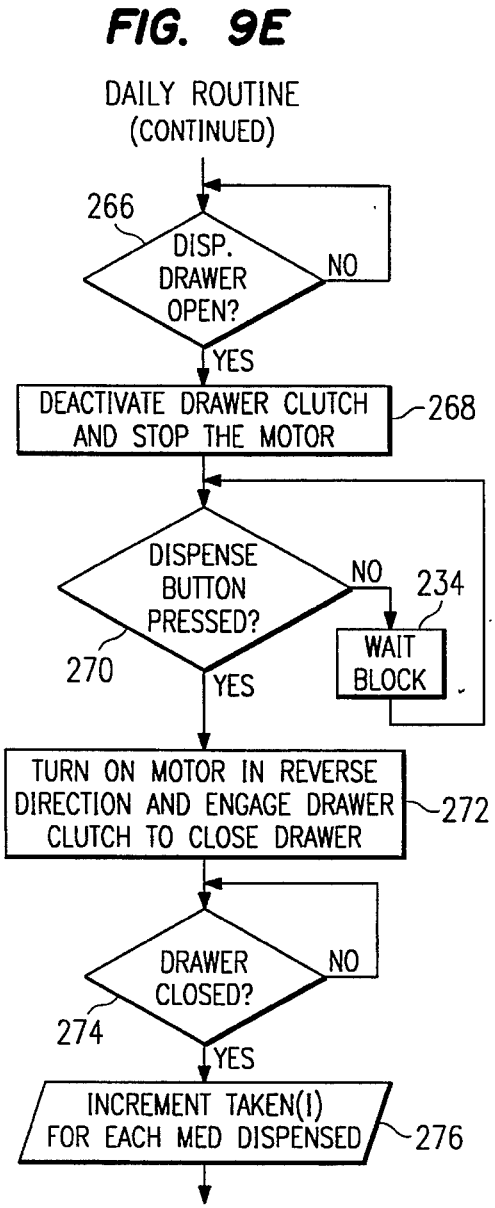
FIG. 9E
DAILY ROUTINE (CONTINUED)
266
DISP. DRAWER OPEN?
NO
YES
DEACTIVATE DRAWER CLUTCH AND STOP THE MOTOR
268
DISPENSE BUTTON PRESSED?
NO
234
WAIT BLOCK
270
YES
TURN ON MOTOR IN REVERSE DIRECTION AND ENGAGE DRAWER CLUTCH TO CLOSE DRAWER
272
DRAWER CLOSED?
NO
274
YES
INCREMENT TAKEN(I) FOR EACH MED DISPENSED
276

MIDWEEK CHANGE ROUTINE

REFILL ROUTINE

AUTOMATIC PILL DISPENSING APPARATUS

CROSS REFERENCE TO RELATED APPLICATION

This is a continuation of prior pending patent application Ser. No. 08/000,260 entitled, "Automatic Pill Dispensing Apparatus," filed Jan. 4, 1993, by the same inventor for which benefit is claimed under 35 U.S.C. §120.

BACKGROUND OF THE INVENTION

This invention relates to pill dispensing apparatus, and more particularly to an automatic pill dispensing device for dispensing a plurality of pills at selected times over a predetermined period of time.

The use of daily medication is common today, particularly among the elderly. In the United States alone, more than half of those over the age of 65 suffer from chronic aliments which require daily medication. Many of the elderly are in nursing homes or being attended by health care professionals. However, many others must care for themselves and make certain that the medication is given in proper doses and at proper times. This particularly becomes a problem with the elderly who suffer from loss of memory regarding the location and dosage of medication. The elderly frequently also have difficulty opening pharmaceutical containers because of arthritis and other physical impairments.

There is also a difficulty with those who must take a plurality of different medications at the same time. The elderly, in particular, have problems with remembering and dealing with several different medications requiting different doses at different times and frequencies. Such problems may lead to overdosage, under dosage or improper combinations of doses, any one of which can be harmful and even life threatening. The resulting anxiety and loss of peace of mind to both the elderly and their families and friends can hardly be over-estimated.

Numerous devices have been developed for automatically dispensing pills and medication at timed intervals. U.S. Pat. No. 4,207,992 (Brown) discloses a timing mechanism having a dispensing wheel with a plurality of medication storage compartments. Each compartment empties into a hopper which can be accessed by the user.

U.S. Pat. No. 4,573,606 (Lewis et al) discloses a similar device including an alarm means to alert the patient at the time pills are dispensed. U.S. Pat. No. 4,674,651 (Seidmore, et al.) discloses another such rotating canister apparatus in which pills fall from each compartment into a chute at given time intervals.

These prior art devices and others do not provide for a means for simultaneously taking several different medications, each having different dosages and time intervals. Although some prior art devices contemplate loading a plurality of pills in each compartment to take care of this problem, such cannot be done legally by a pharmacist, who must load each container with a specific prescription. To the extent that such is done by the patient, it is subject to layman error resulting in incorrect and even harmful doses.

These prior art devices also do not resolve the problem of preventing overdoses. If the medication dropped into the hopper is not taken, it remains there for later consumption when other medication has been added to the hopper. Even with the presence of an alarm, the elderly and others may become confused or may shut off the alarm without taking the medication.

The prior art devices also do not provide for a means of physically removing the pills and medication from each compartment in the rotating cartridge. Pills are frequently gelatin capsules or otherwise susceptible to becoming sticky and adhering to the inside of a cartridge compartment. Consequently, such medication may not easily fall out of a dispensing device at the time needed.

Consequently, there exist a need for a simple and reliable automatic mechanism to dispense a plurality of pill prescriptions at timed intervals and proper dosages. There is also a need for notifying the user that the pills are ready at the appointed time and for avoiding overdoses by limiting availability of the pills to only the dose to be taken at the time and by keeping an accurate record of all medication taken. There is also a need for having such a system which is easy to operate and maintain, which can be filled by a competent pharmacist and which can automatically operate for a sustained period of time, such as a week, without having to be reset or reloaded.

SUMMARY OF THE INVENTION

Accordingly, the present invention provides for a simple, effective automatic apparatus for dispensing a plurality of medication, each at proper intervals and in proper doses. Moreover, the present invention provides for notification of the user at the time the dosage is ready, avoids overdosage by only making the current dose available and logs a history of all medication provided to the user. The present invention also provides for a means for simply and effectively removing the medication from each compartment in the rotating cartridge, regardless of whether the medication has adhered to the sides of the compartment. Moreover, the present invention provides a means for easily changing the times and frequencies of medication dosages and for easy removal and replacement of rotatable cartridges to expedite being filled by pharmacist.

In one embodiment, a pill dispenser for dispensing sequential pills from selected ones of a plurality of cartridges according to a predetermined prescription schedule comprises a housing adapted for removably holding a plurality of cartridges having pill compartments, the housing having means for collecting pills that are distributed from any cartridge. A plurality of cartridges having the pill holding compartments are removably mounted in the housing, each having a pill dispensing opening adapted for selective positioning in communication with an opening of successive compartments of the cartridges in response to movement of the cartridge, to define a dispensing position of the cartridges. A drive means is operated by a control means for independently moving any given one of the cartridges to the dispensing position so that the pill dispensing opening is in communication with the pill collecting means. The control means moves any of the cartridges to the dispensing position in accordance with the predetermined prescription schedule so that the correct combination of pills become available at intervals according to the schedule.

The cartridges have pill compartments about their periphery, each having an open end at its periphery for moving past an opening. The compartments are closed by a wall having an opening in communication with the housing leading to a dispensing tray. The opening in the wall closing the compartments is in communication with an opening in the housing and one of the compartments. The cartridges are individually rotatable to successive dispensing positions wherein successive compartments are open through the opening in said wall. The wall is preferably provided on a removable cover member which cooperates with the rotatable portion of the cartridge to enclose pills loaded therein by a pharmacist or care giver.

A dispenser means mounted in the housing is movable to close the pill dispensing openings and retain the next-to-be-dispensed pills in their respective compartments. The dispenser means is openable to release pills from the pill dispensing openings into a collection means which comprises a drawer-like tray. The dispenser means preferably comprises a dispenser member which simultaneously opens or closes all of the dispensing openings. The dispensing means includes a pill extractor comprising a sweeping means for moving through each successive compartment when it is located at the pill dispensing opening, to remove the pills contained therein. The sweeping means comprises a wire attached to the dispenser member and movable with it to physically sweep through the compartment as the dispenser member is pivoted to the open position.

The drive means includes a motor and individually engageable clutch means which cause the rotatable pans of the cartridges to rotate in response to a signal from the control means when the drive means is being operated. The control means includes a programmable microprocessor-computer programmed to receive, store and process the predetermined prescription schedule and in combination with a real time clock means, determine the time for dispensing pills, operating the drive means for the cartridges having the pills to be dispensed and signalling that the dispense time has arrived. It includes a keyboard input for prescription data which is conveniently mounted in the housing. The keyboard is used to input the prescription schedule for each of the medications that will be included in each of the cartridges. Each cartridge is designed to accept a single type of medication in the form of a pill or pills placed in each compartment when the machine is loaded.

Sensing means associated with each cartridge in the housing provide signals to the control means to enable the control means to successively position the cartridges at successive dispensing positions. The sensing means comprise electric eyes mounted in the housing and directed toward the rotatable portions of the cartridges to signal the control means when the compartments are aligned with pill dispensing openings. This enables the control means to advance the cartridges one compartment at a time. The drive means includes a common shaft on which the clutch means for the cartridges are mounted for rotation, including complementary gear means on the rotatable portion of the cartridges and the clutch means for the cartridges. The complementary gear means cooperate to turn the rotatable portions of any one or all the cartridges in response to signals from the control means.

The novel features and construction of the present invention, as well as additional objects thereof, will be understood more fully from the following description when read in connection with the accompanying drawings:

BRIEF DESCRIPTION OF THE DRAWINGS

FIGS. 9A–J are flow diagrams showing the operation of a preferred embodiment of the present invention.

DESCRIPTION OF PREFERRED EMBODIMENT

Figure 1:
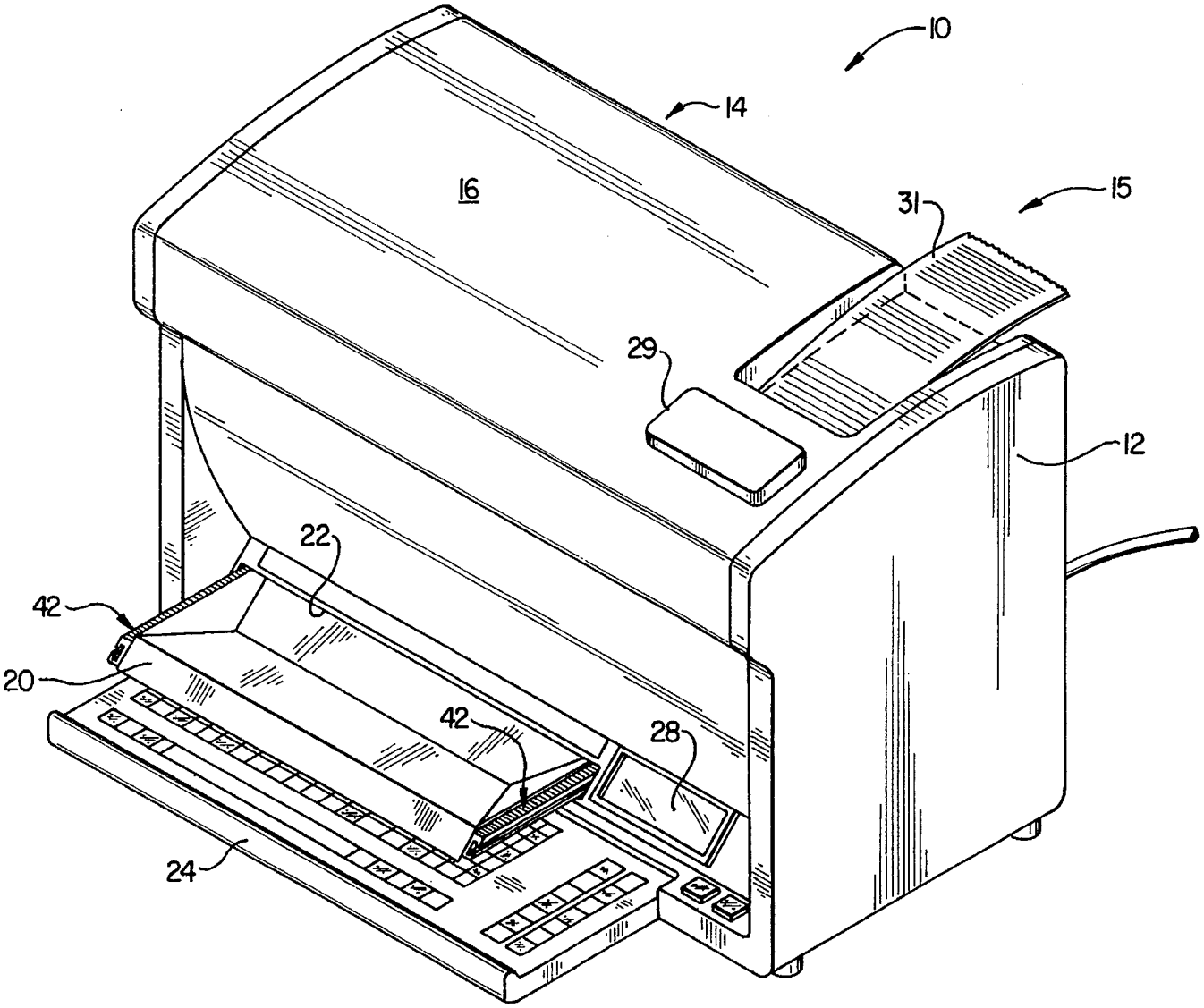
FIG. 1 is a perspective view of the pill dispensing apparatus of the present invention.

Referring now to FIG. 1, a preferred embodiment of the automatic pill dispensing apparatus of the present invention is depicted therein. The pill dispensing apparatus 10 includes a housing 12 having a mechanical section 14 and a microprocessor section 15, accessible by a hinged lid 16 which is locked in place by a solenoid lock. A dispensing tray 20 retracts and extends within a rectangular slot 22 in the base of housing 12.

A keyboard 24 is disposed at the base of housing 12. An electronic display window 28 is provided just above keyboard 24. Dispense button 29 is suitably located for actuating a dispensing means, to be discussed later. A conventional printer may also be included (not shown) for printing out a record 31 of the medication taken. A microprocessor computer capable of processing data according to an algorithm and electronic circuitry (not shown) are also provided in housing 12, as discussed herein with regard to FIG. 8.

Figure 2:
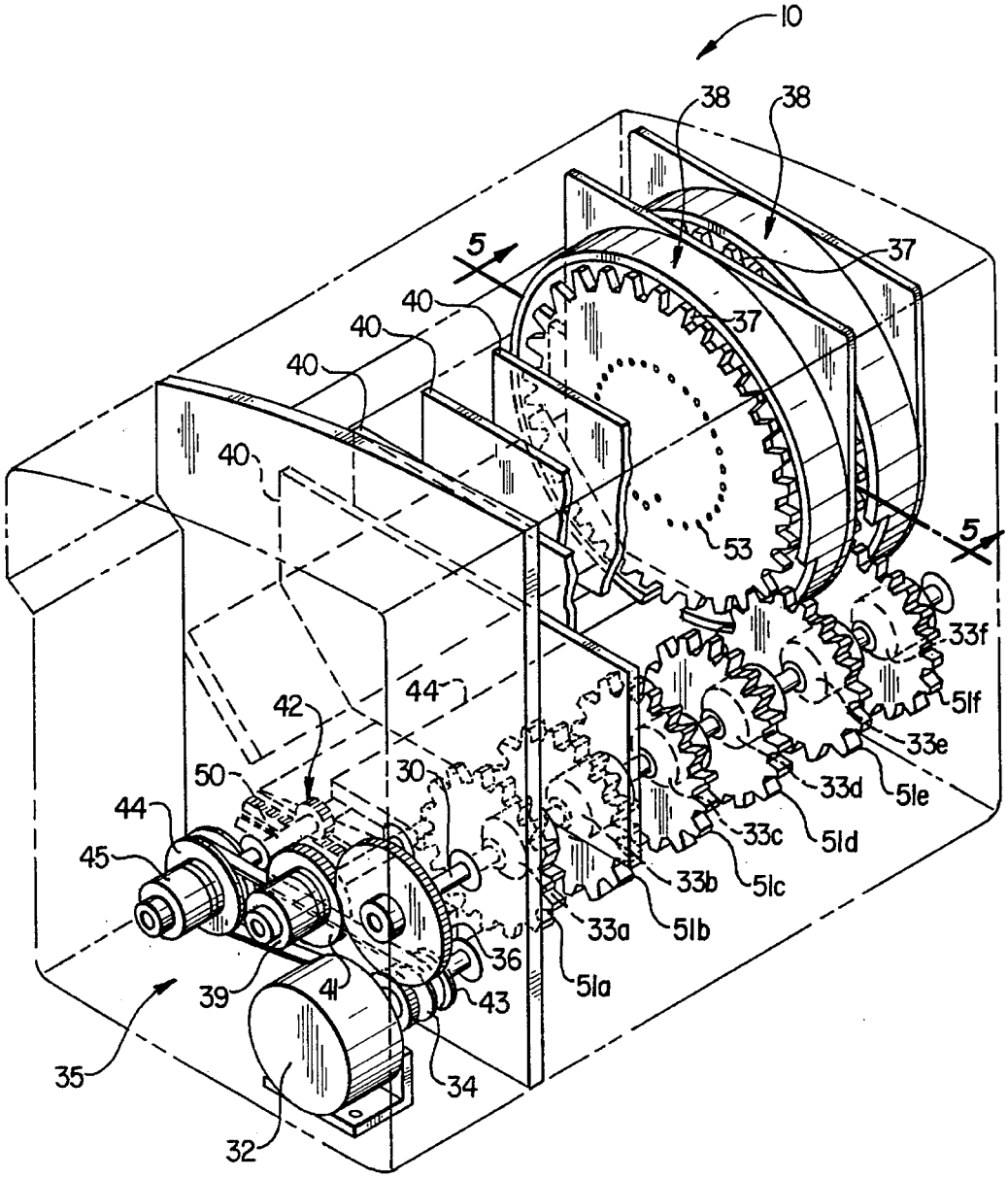
FIG. 2 is a partially cut away perspective view of the mechanical portion of the automatic pill dispenser shown in FIG. 1.

Looking now at FIG. 2, the mechanical structure of the pill dispensing apparatus shown in FIG. 1 is depicted. Drive means 35 includes a rotatable shaft 30 with electro-mechanical clutches 33*a–f* disposed horizontally within housing 12 and is driven by an electrical motor 32 through gears 34 and 36. Motor 32 may be a stepper motor which can be run like a regular motor or stepped, if desired. The clutches prevent the gear train from rotating the cartridges, even if shaft 30 is driven. These clutches have one part which rotates with the shaft and another that rotates with the shaft only when the clutch is engaged. A plurality of removable circular cartridges 38 having a rotatable part having gear teeth 37 are rotated by gears 51*a–f* mounted on shaft 30 and actuated by clutches 33*a–f*. Between each set of adjacent cartridges 38 is a divider plate 40 which help support the cartridges.

A dispensing bar 44 is pivoted by another electro-mechanical clutch 39 and gear 41 driven by a motor 32. A spring may be provided to bias dispensing bar 44 to return it to the horizontal position after actuation by motor 32 or preferably the control means reverses the direction of motor to return dispensing bar 44 back to the closed position where it simultaneously closes all dispensing openings of the cartridges.

Collecting tray 20 is shown in its extended position in FIG. 1 and in the retracted position in FIG. 2. When in the retracted position, the patient cannot access any pills. A longitudinal shaft 50 drives a rack and pinion designated generally 42 which serves to translate tray 20 between the open position of FIG. 1 and the closed position of FIG. 2. Shaft 50 is rotated by motor 32. A pulley 43, attached to circular shaft 30 is connected by a belt to pulley 44 attached to electro-mechanical clutch 45 mounted on shaft 50. Then the belt and pulleys turn whenever motor 32 is running, but shaft 50 only turns when clutch 45 mounted on shaft 50 is activated. Shaft 50 is rotated upon actuation, to horizontally extend or retract tray 20.

Figure 3:
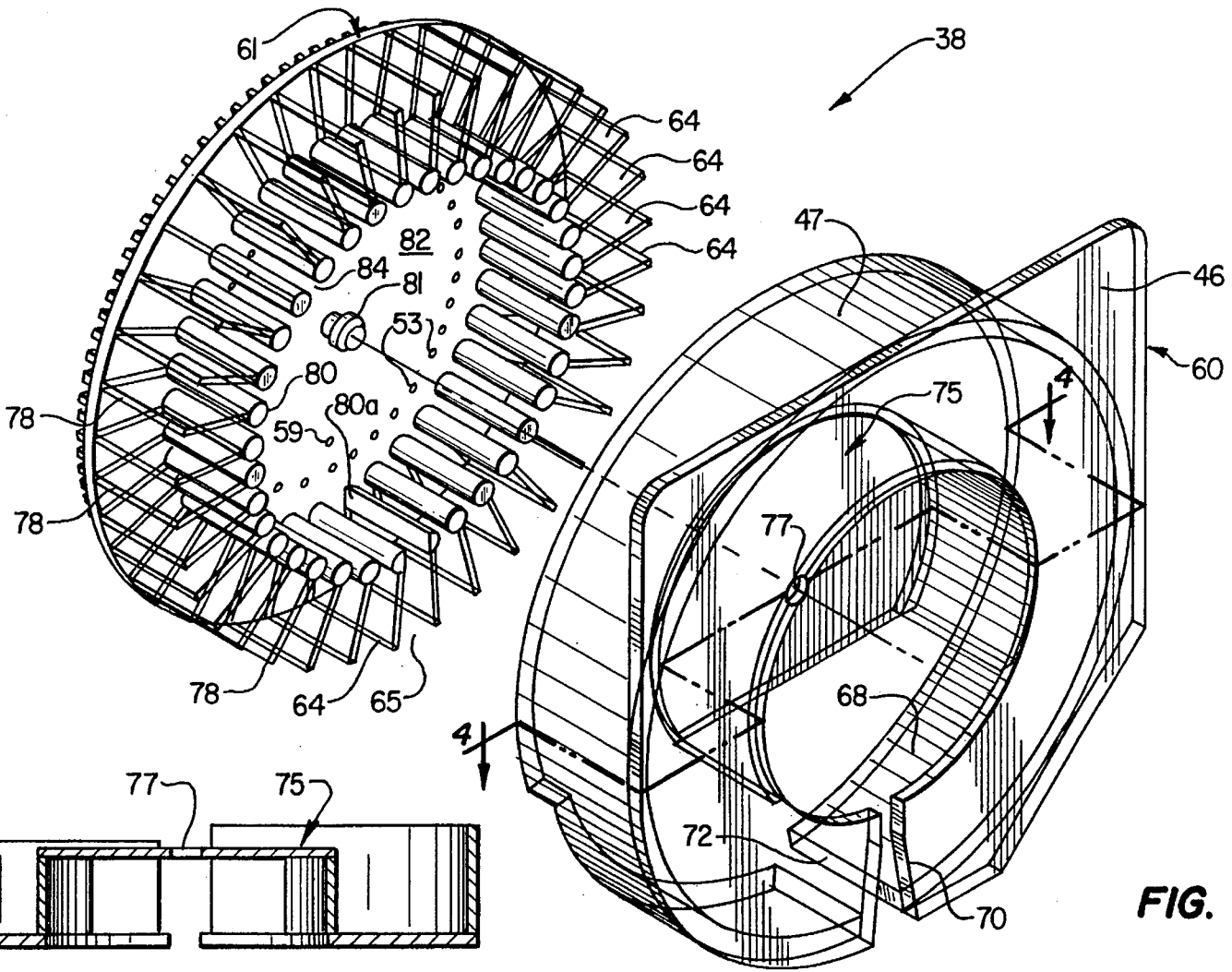
FIG. 3 is an exploded, perspective view of the cartridge.
Figure 4:
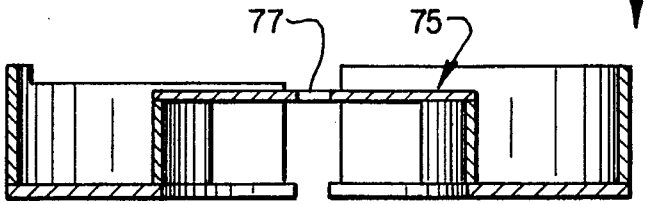
FIG. 4 is a cross-sectional view taken along line 4—4 shown in FIG. 3.

Looking now at FIGS. 3 and 4, cartridge 38 comprises two elements; a cover member 60 and a rotatable inner part or unit 61 having a plurality of multiple pill compartments 64 therein and gear teeth 37 formed on the outside of circular back wall 82. Cover member 60 has a flat wall 46 from which projects at fight angles a cylindrically shaped wall 47 to receive rotatable unit 61 therein so that the outer peripheral opening of each compartment 64 is closed at its outer periphery by close proximity of the inner cylindrical surface 68 of wall 47. A vertical slot 70 is cut into the face of flat wall 46 of cover 60 and adjoins with a horizontal slot 72 cut into cylindrical wall 47 at the base of cover member 60. Vertical slot 70 is used to allow the cartridge to pass over the photo-electric cells 100 best seen in FIGS. 5 and 7. The cartridges 38 are placed into guide slots formed by the divider plates 40 and receive support from the housing.

Rotatable part 61 comprises a plurality of radially extending adjacently oriented walls 78, each of which extend from a post 80 disposed parallel to wall 78 and extending perpendicular from back wall 82 of rotatable part 61. The plurality of posts 80 and pairs of adjacent walls 78 form the open-ended pill compartments 64 all around the outer periphery of portion 61. Cover 60 and rotatable inner unit 61 are removably attached by a button post 81 mounted in the center of rotatable inner unit 61. This post has a small detent on its end. This detent passes through an opening 77 in the center of an inner housing 75 best seen in FIG. 4, causing the two pieces of cartridge 38 to be firmly held together. When assembled with cover 60, compartments 64 of rotatable unit 61 are closed off at the outer periphery by the inner cylindrical surface 68 of wall 47. The inner other ends of compartments 64 are partially closed off by adjacent posts 80, leaving a slot 84 between posts 80 for use to be described later. Gear teeth 37 are formed on the back surface wall 82 of cartridges 38. These teeth, in conjunction with the pinion gears 51*a–f* and clutches 33*a–f* attached to shaft 30 are used to turn the rotatable inner unit during the operation of the machine. A plurality of radially arranged sensor openings 53 are located in the rotatable inner unit 61 just inside the ting formed by the posts 80 at the inner ends of compartments 64. These holes are used in conjunction with photoelectric cells (photodetectors) to register the position of cartridge 38 during rotation.

Figure 5:
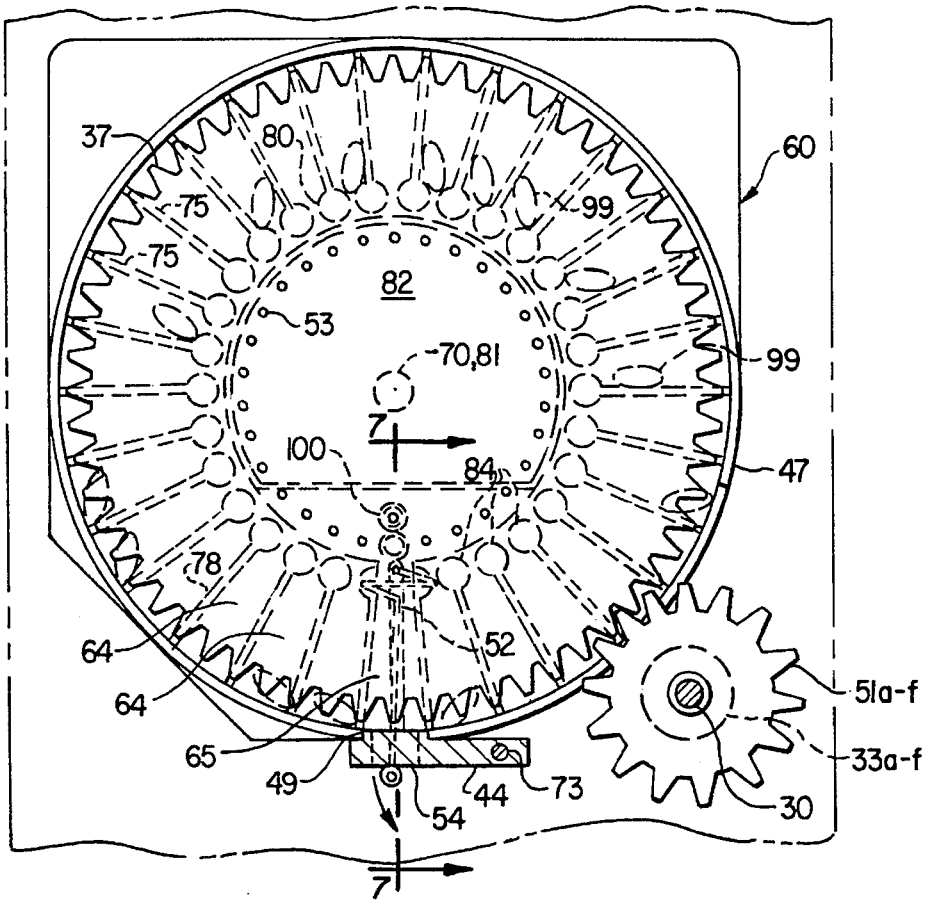
FIG. 5 is a side view of the cartridge and dispensing member taken on the line 5—5 of FIG. 2.
Figure 6:
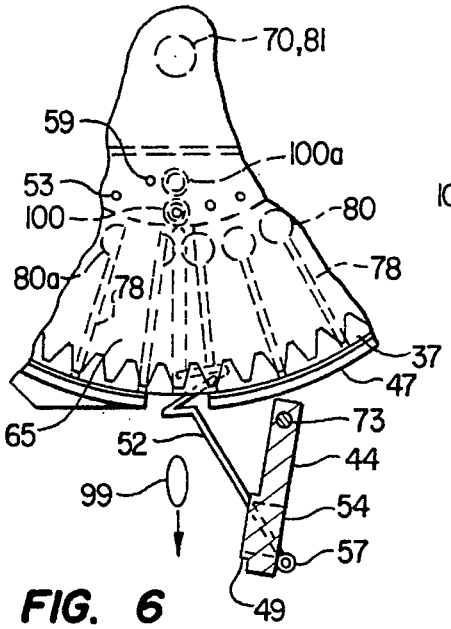
FIG. 6 is a cutaway detail elevation of the pill ejection means shown removing a pill from a compartment.

Looking now at FIGS. 5 and 6, a cartridge 38 is shown mounted between divider plates 40. The gear teeth 37 on the back of cartridges 38 are meshed with a pinion gear 51*a–f* attached to a clutch 33*a–f* on shaft 30. Rotatable unit 61 is shown mounted within cover 60 with the outer peripheral opening of compartments 64 between the outer ends of radial walls 78 abutting the inner circular surface 68 of wall 47 of cover 60. Button post 81 mounted on rotatable unit 61 is inserted into circular opening 70 in the center of inner housing 75 of cover 60.

Dispenser bar 44 is shown horizontally disposed to pivot about pivot point 73. Dispenser bar 44 is horizontally disposed having an upwardly projecting laterally extending cap 49 positioned to engage each slot 72 comprising a pill dispensing opening in cover member 60. This seals off slot 72 and prevents pills 99 from dropping out of slot 72. A pill sweeping means comprises a dislodging wire 52 pivotally mounted on the outer lower end of dispenser bar 44 and extends upwardly through slot 54 behind compartments 64 as shown.

Figure 7:
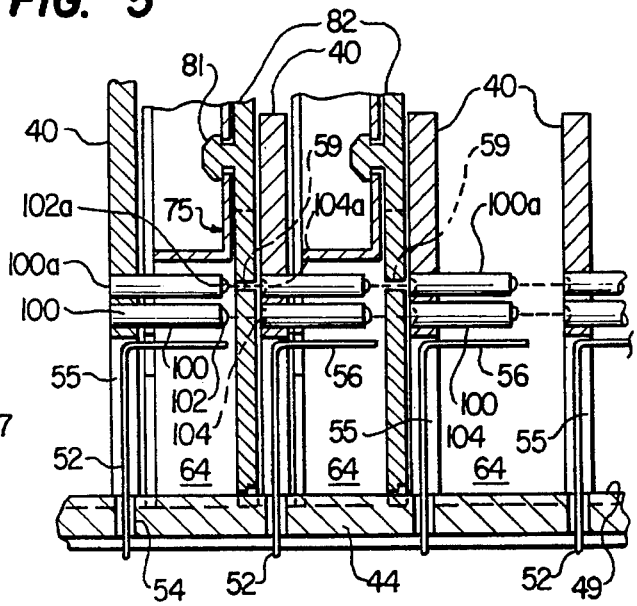
FIG. 7 is a cross sectional elevation of the cartridges of FIG. 2 taken on the line 7—7 of FIG. 5, which shows the pill ejection means and sensors to track the position of the cartridges.

As best seen in FIGS. 6 and 7, wires 52 and dispenser means 44 do not interfere with relative rotation of rotatable part 61 of cartridges 38 with respect to fixed cover 60. Wires 52 are adapted to move up and down in slots 55 in dividers 40 and the horizontally projecting part 56 of wire extends through narrow spaces 84 between and above adjacent posts 80, thus no part of wires 52 interfere with rotation of cartridges 38. Since cap portion 49 of dispenser 44 is adapted to fit only within the wall thickness of slot 72, it does not interfere either. The wire may be bent as shown for strength and resilience.

As shown in FIG. 6, dispenser bar 44 may be pivoted away from a horizontal position about pivot point 73, thereby removing the surface of cap 49 from slot 72. This allows pill 99 to fall downward with the force of gravity and out of compartment 64. Wire 52 is pulled down through compartment 64 to assist in dislodging pill 99 as needed. As can be seen, wire 52 is rotatably mounted on hinge 57 to extend through a slot 54 in dispenser bar 44.

Referring now to FIG. 7, a cross section is shown along line 7—7 from FIG. 5. Wires 52 extend radially between adjacent walls 78 of cartridges 38 and include perpendicularly extending end 56 which is used to sweep through compartments 64 when dispenser bar 44 is pivoted open. A photoelectric cell 100 includes a transmission end 102 projecting a light through openings 53 to the receiver end 104 of the next photoelectric cell 100. As the rotatable inner unit 61 of cartridge 38 rotates, the light path is blocked because the rotatable inner unit wall 82 rotates into the light path. When the light path connection is complete again the appropriate electronic circuit to the control means registers that a given one of rotatable inner units 61 is at the next compartment 64. The clutch is instantly disengaged to stop further rotation of cartridge 38.

FIGS. 5–7 also illustrate the use of home compartment 65, home opening 59 and photoelectric sensors 100*a* mounted just above sensors 100 in the divider walls 40. Home compartment is the only compartment in which pills are not deposited. It is formed between adjacent radially extending walls 78 just like compartments 64 but the inner end is wider because posts 80*a* are cut away. This is so in order that cartridges 38 can fit down over the sensors 100, 100*a* when the cartridges are dropped into the guide slot between adjacent divider walls 40. A home opening for passage of light from upper sensors 100*a* is provided in wall 82 of rotatable part 61, located radially inward from dispense position openings 53 which cooperate with sensors 100. Sensors 100*a* have transmission end 102*a* which sends light through openings 59 to receiver ends 104*a* at one end of the next sensor 100*a* as shown in FIG. 7. The signal from these sensors is provided to the microprocessor so that it can determine if a cartridge has been inserted into the guide slots when the beam is broken and likewise determine which of the cartridges have been removed. This is built into the algorithm and is especially useful if a midweek alternation of the dispensing schedule is requested for any one of the medications and helps insure that the correct cartridge is removed, refilled and replaced. It is also conventionally coupled with the microprocessor to indicate when rotatable part 61 has rotated fully and must be replaced.

Ideally, cartridges 38 are each removed from the guide slots and loaded by a home health care provider or taken to the pharmacist to be refilled. Preferably, if the cartridges are loaded by a pharmacist, they are sealed and not opened or breached by anyone, thus insuring the integrity of the medication and dosage.

A wheel lock may conventionally be added as an option to hold the rotatable portion from turning while it is out of the housing which can be unlocked when it is returned to the housing.

The pill dispenser apparatus of the present invention is operated by first inputting the appropriate time and date on key pad 24. The machine is reloaded and reset as needed. The prescription number for each of the cartridges is also entered in the key pad, as well as the dosage amount and frequency. A major advantage is that the dispensing times and dates are input through the keyboard, allowing greater flexibility in medication times. The prescription number, medication name and pharmacist telephone number can be input, which provides a way to determine the prescription name, if necessary.

Using the present preferred embodiment, up to six cartridges may be loaded into guide slots. The clutches 33*a–f* that control the rotation of the cartridges are activated independently of each other. When the machine arrives at a medication time, an alarm sounds, alerting the user that medication is ready. If the dispense button is pressed, the appropriate clutches are activated and the selected cartridges are indexed 1 compartment. The photoelectric cells control stopping the cartridges. When the photoelectric cells 100 sense light through a hole 53 in the rotatable unit, the clutch is deactivated. Thus, not only are the dispense times completely unrestricted, each of the wheels is filled completely (i.e., no empty pill compartments), but the next refill time is completely controlled by the frequency of medication.

With the preferred embodiment, there are 29 pill compartments used for dispensing pills and a home compartment. Each cartridge is divided into 30 compartments, each having 12 degree angles. The Pill Dispenser, with pill wheel cartridges, is driven by electric or mechanical clutches, whereby one motor or prime mover can be used to turn any number of pill wheel cartridges at the same time or independent of each other, or any combination of wheels turning, as determined by which clutch or clutches are actuated. The motor turns the shaft to which the rotor of each clutch is also attached. Thus the rotor turns. The pinion gear or other driving means is attached to the armature disk, which is also on the same shaft near the rotor. The armature is centered on the shaft but not attached to the shaft nor to the rotor, but only to the pinion gear. When the coil is actuated, the magnetic field pulls the actuator disk against the friction material on the rotor and the armature is constrained to rotate with the rotor and motor shaft.

The force of the coil pulling the armature disk against the rotor friction surface is a normal force that results in non-sliding of the armature disk surface relative to the rotor circular surface. Since the rotor is turning, the armature turns as if it were a part of the rotor up to maximum torque allowed by normal force and coefficient of friction between the surfaces. As the armature turns, the pinion gear or pulley attached to it also turns and drives the pill wheel gear or pulley to allow a pill-bearing compartment to be placed over the dispensing opening. When the coil is turned off, the armature pulls away from the turning rotor and no longer turns due to the friction of the pill wheel and its connection to the armature via the pinion wheel.

If the user does not actuate the dispenser bar, the medication remains in each wheel because no indexing ever occurs. Thus, no extra medication collects in the tray of the apparatus, and there is no possibility of inadvertently taking an overdose. Moreover, at the end of the medication cycle, a person refilling the prescription can determine by the amount of medication left in each wheel what was missed by the user and take appropriate remedial steps.

When the user is alerted that it is time for the next medication, the user actuates the dispenser bar 44 by pushing dispensing button 29 on the housing. This action also actuates motor 32 and the dispensing tray belt and pulley system which extends tray 20 outward for the user to obtain the medication. After the medication has been taken, the tray is retracted by pushing the dispense button or will be automatically retracted before the next dispense cycle.

Preferably at the time of each dosage, the machine may display and/or print out the date and time and the prescription or prescription number. Another display or printout may be obtained on demand giving the prescription number, the pharmacy number and the dosages taken for the week.

Figure 8:
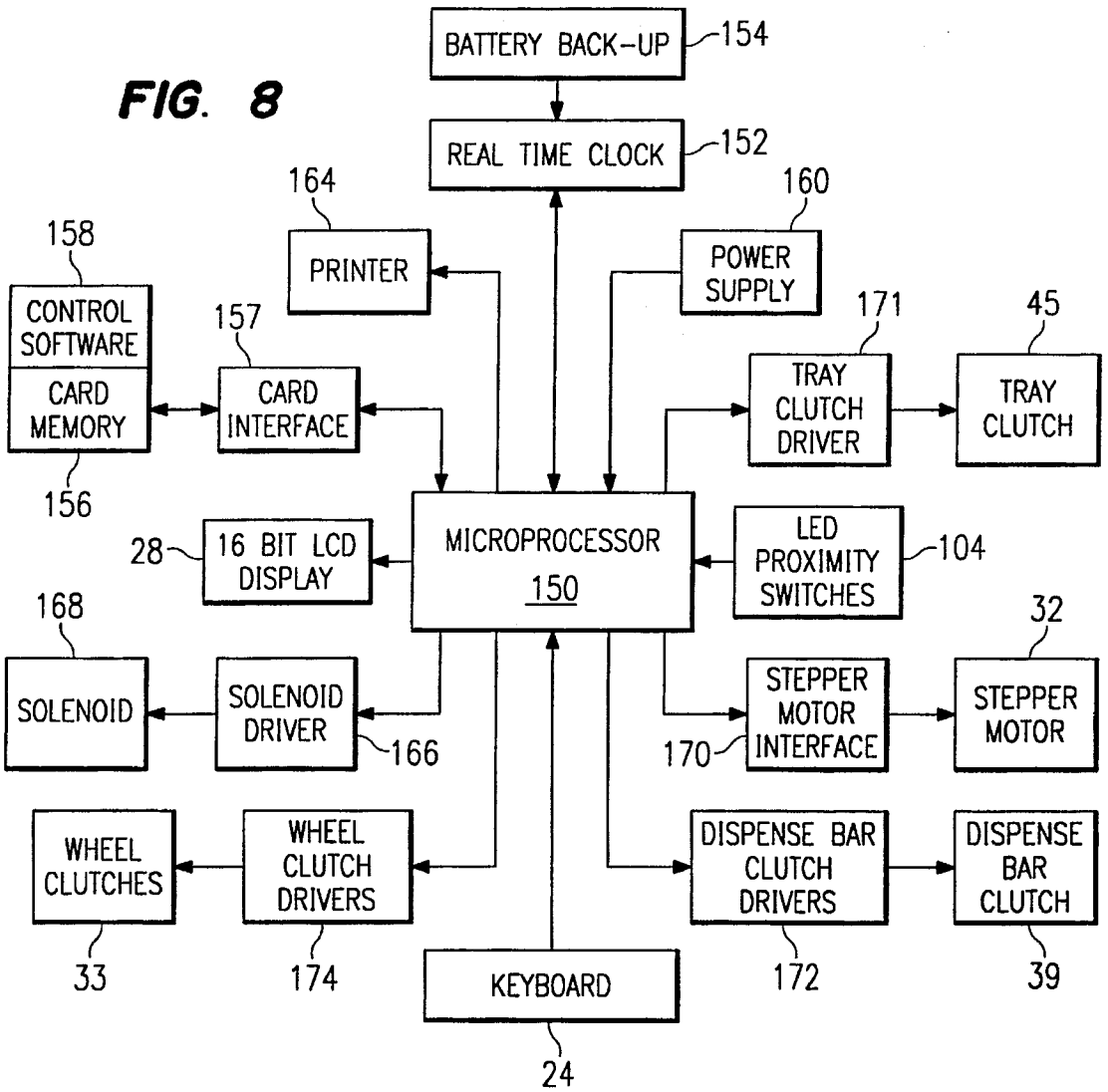
FIG. 8 is a block diagram of the microprocessor and electronics of the preferred embodiment of the invention.

Referring now to FIG. 8 in more detail, the electronic circuitry is designed around microprocessor 150 which is preferably a Motorola model number 6805 or 68HC11. The microprocessor 150 has an associated real time clock 152 which is preferably Motorola model 146818. The real time clock 152 provides time-of-day information to the microprocessor 150, as contrasted to the microprocessor's internal clock (not shown), which is used only for relative timing of operations within the microprocessor 150. The real time clock 152 has a battery back-up circuit 154, preferably Dallas Semiconductor model 1210.

Microprocessor 150 interfaces with insertable card memory 156 through card memory interface circuit 157. Memory 156 is used to store compliance data as well as control software 158 which is discussed in greater detail hereinafter with reference to FIGS. 9A–9J. Any memory type suitable for nonvolatile storage of control software 158 may be used for memory 156, however insertable card memory is preferred because it allows convenient updating of revised versions of operating program 158. Use of insertable card memory for memory 156 is also preferred because it allows the storage of a record of dispenses to the patient for later legal verification purposes as required.

The entire circuit is powered by a conventional AC/DC power supply 160. A keyboard 24 and LED proximity switches 104, which are activated by photoelectric cells 102, feed input information to the microprocessor 150. Microprocessor 150 outputs information to LCD display window 28 and also to printer 164.

Actuation signals generated by the control software 158 are outputed to solenoid drivers 166 which drive solenoids 168 which actuate a door latch to prevent the patient from accessing the cartridges 38. Microprocessor 150 also outputs control signals to a MOSFET type stepper motor interface 170. Stepper motor interface 170 sends actuation signals to stepper motor 32. Further actuation signals generated by the control software 158 are output by microprocessor 150 to the dispense bar clutch driver 172, which drives dispense bar clutch 39 which actuates the dispense bar in response to the patient pressing the dispense button 29. Microprocessor 150 outputs control signals to wheel clutch drivers 174 which drive the wheel clutches 33 and to tray clutch driver 171 which drives tray clutch 45.

Figure 9A:
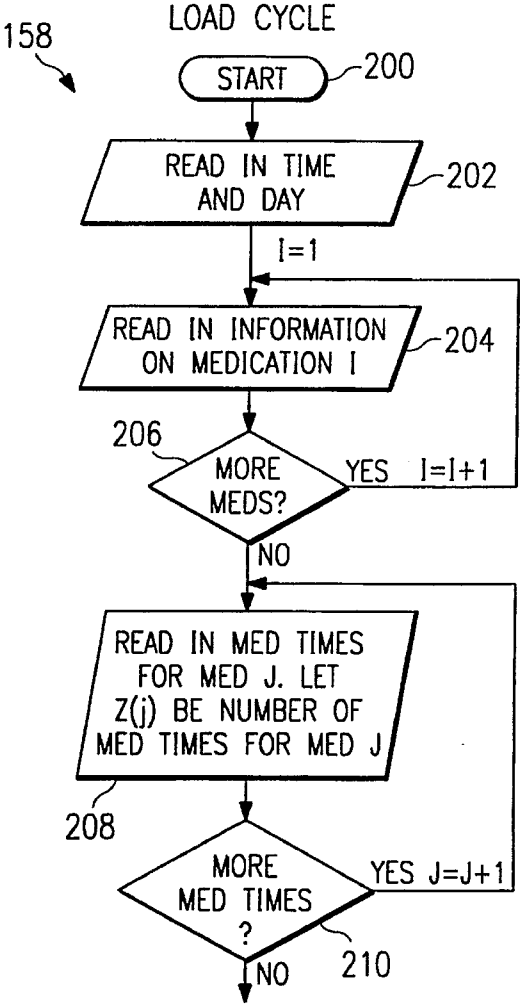

FIGS. 9A–9J show flow diagrams of a preferred embodiment for carrying out the control software 158. Referring first to FIG. 9A, the control software 158 begins at start block 200 and proceeds to input block 202 where the care giver inputs the current time and day. The software then sets variable i= 1. Input block 204 then receives information on medication Med(i), which is the first medication, Med(1), at this time. Next, decision point 206 asks the care giver if there are any more medications to be input. If the care giver indicates that there are, the process increments the variable i and returns to input block 204. If the care giver indicates that there are no more medications to input information for, the process sets a variable j=1 and moves to input block 208. Input block 208 prompts the care giver for the medication dispensing times for medication j, which is the first medication, Med(1), at this time. The software then determines the frequency Z(j) (the number of times per day the medication is to be dispensed) for this medication. Decision point 210 then determines if there are more medications Med(j) to input medication dispensing times for. If there are, the process increments the variable j and returns to input block 208. If all of the medication dispensing times have been input for all of the medications, the process then continues at block 212.

Figure 9B:
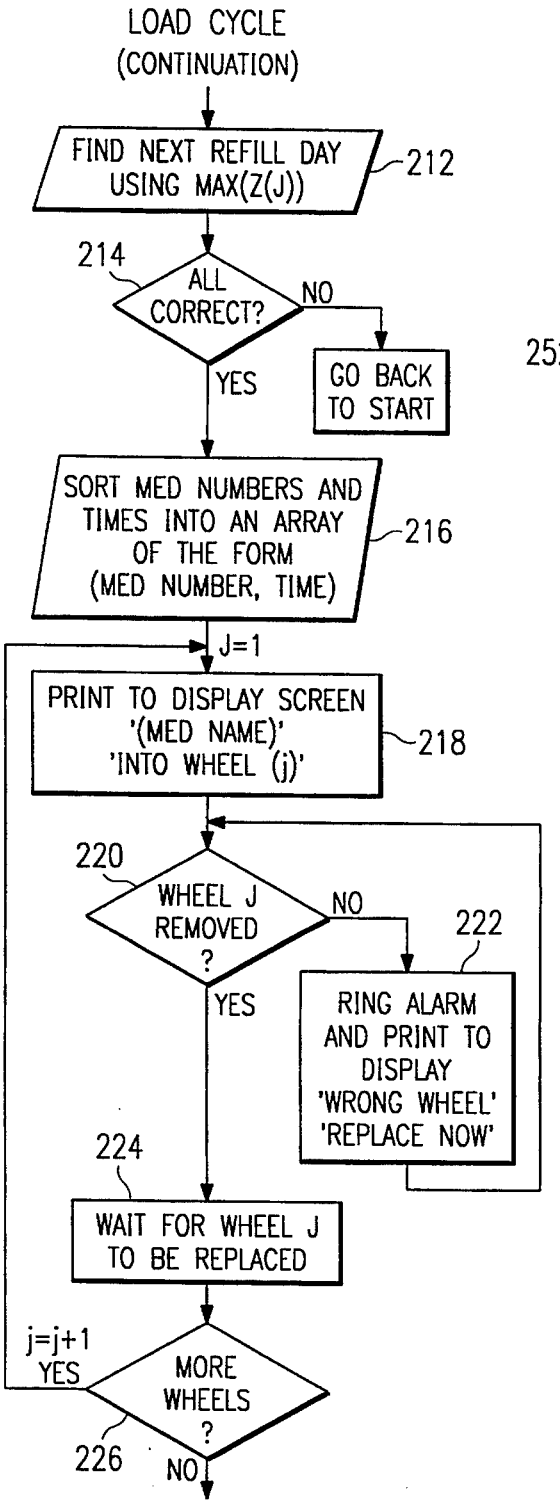

Referring now to FIG. 9B, block 212 determines when the pill dispenser 10 must next be refilled by finding the medication Meal(i) which has the highest medication dispensing frequency Z(j). The medication with the highest medication dispensing frequency Z(j) will be exhausted first, at which time the pill dispenser 10 must be refilled. The control software 158 will then display to the care giver what day the pill dispenser 10 must be refilled. The process then continues at decision point 214, which allows the care giver to start the process over if he feels that either all of the information was not entered, or that some of the information was entered incorrectly. If this is the case, the process returns to start block 200. If the care giver indicates that all of the information was entered correctly, the process sons all of the medication dispensing time information into time order by forming an array at block 216 in the form (Med #,time), where time is sorted into order from the time nearest in the future to the time most distant in the future. The process then begins the sequence of loading the medications into the cartridges 38 by setting the variable j= 1 and printing to the display screen 28 a command instructing the care giver to load Med(j) into cartridge(j) at block 218. Decision point 220 checks to see if the care giver removed the correct cartridge(j). If the incorrect cartridge was removed by the care giver, block 222 sounds an alarm and instructs the care giver to re-insert the cartridge and to remove the correct cartridge(j). If the correct cartridge(j) was removed at decision point 220, the process pauses at block 224 and waits for the care giver to place the cartridge(j) back into the pill dispenser 10. Once the cartridge(j) is returned, decision point 226 determines if there are more cartridges(j) which must be filled. If there are, the variable j is incremented and the process returns to block 218. If not, the process continues to decision point 228. FIGS. 9A and 9B represent the loading routine of the control software 158. The daily routine of the control software 158 begins in FIG. 9C.

Referring now to FIG. 9C, decision point 228 determines if the current time of day is more than one hour past the first medication dispensing time in the array (Med #,time). This must be determined because the pill dispenser 10 will not dispense medications more than one hour after their scheduled dispensing time. If decision point 228 determines that the current time is more than one hour past the first medication dispensing time in the array, block 230 retrieves the next entry in the array and the process returns to decision point 228. This loop is repeated until a medication dispensing time is found in the array which is either a future time or is not more than one hour before the current time. Decision point 232 then determines if the current time is past the next medication dispensing time found by decision point 228. If the medication dispensing time has not yet arrived, the process executes wait block 234 (see FIG. 9G) and then returns to decision point 232.

If the current time is past the medication dispensing time, the process moves to decision point 236 which checks to make sure the current time is not more than one hour past the medication dispensing time. The decision point 236 is not a duplication of the test already performed at decision point 228 because the second test will keep the patient from dispensing the medication if more than one hour elapses between the medication becoming available and the patient pressing the dispense button 29. For example, if more than one hour has elapsed at decision point 236, the compliance data array fail(i) is incremented at block 238 for each medication missed at this dispensing time. Decision point 240 then determines if another medication window is open (for example, the one hour window may not yet have expired for one or more of the other medications currently being dispensed). If there are no other medication windows currently open, the process returns to decision point 232.

If, however, there are other medication windows which have not yet expired, or if the answer at decision point 236 was previously "no", the process continues at block 242 which sounds an alarm and instructs the patient to press the dispense button to receive the medication. While the pill dispenser 10 is waiting for the patient to press the dispense button, it checks at decision point 244 whether any other medication times have arrived. If one or more has, block 246 adds the correct cartridge number to a queue which keeps track of which medications are to be dispensed when the patient presses the dispense button. (Additionally, the medication dispensing which failed at decision point 236 was removed from this queue so that it will not be dispensed when the patient presses the dispense button). Next, decision point 248 checks to see if the dispense button has been pressed. If it has not, the process executes a wait block 234 and then returns to decision point 236. If the patient has pressed the dispense button, the process continues at block 250.

Figure 9D:
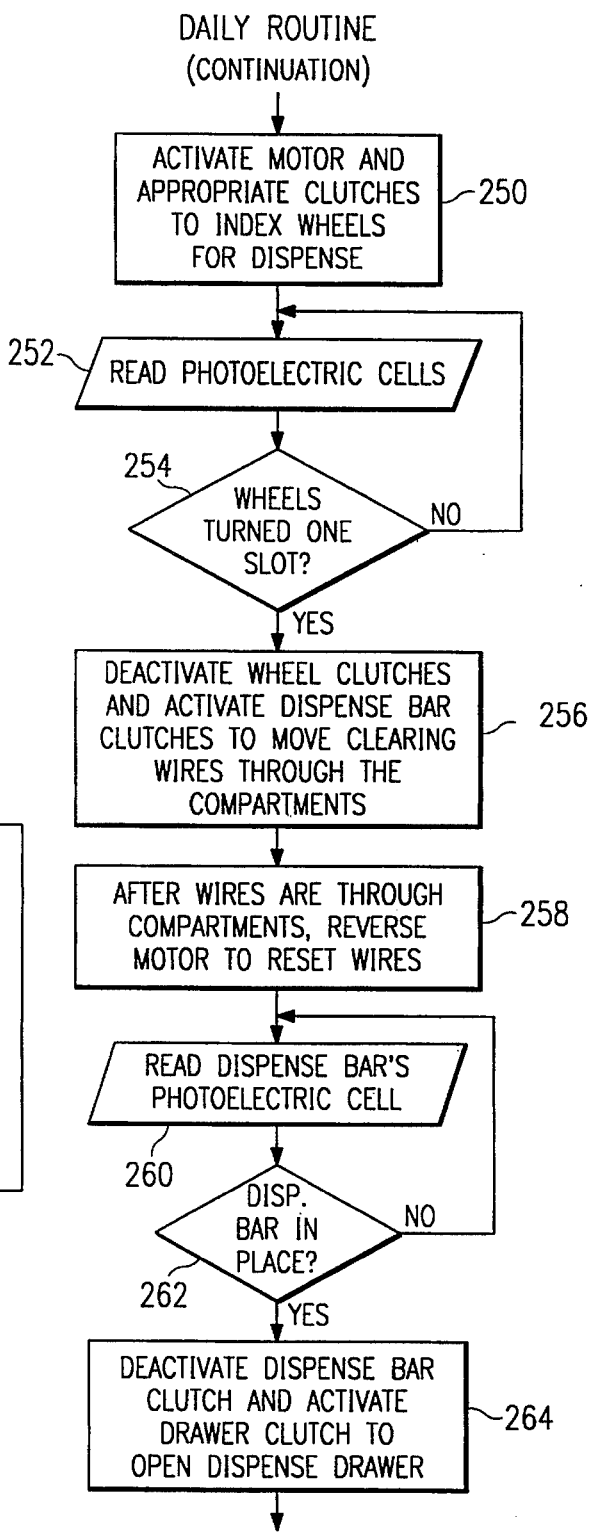

Referring now to FIG. 9D, block 250 activates the stepper motor 32 and the appropriate clutches 33 (using the information in the queue) to index the appropriate cartridges for dispensing. The photoelectric cells 100 are read and decision point 254 determines, using the information from the photoelectric cells 100, if the appropriate cartridges have been rotated one position. If the cartridges have not yet been rotated to the next position, the process returns to block 252. If, on the other hand, the cartridges have reached the next position, block 256 deactivates the wheel clutches 33 and activates the dispense bar clutch 39 to move the clearing wires 52 through the compartments. The wires 52 are reset at block 258 by releasing the dispense bar after they have moved through the compartments. The photoelectric cell for the dispense bar is read at block 260 and decision point 262 determines if the dispense bar is in place. If it is not, the photoelectric cells are read again at block 260. If the dispense bar is in place, block 264 deactivates the dispense bar clutch 39 and activates the drawer clutch 45 to open the dispense drawer 20. The process then continues at decision point 266.

Referring now to FIG. 9E, decision point 266 determines if the dispense drawer has been fully opened. When it has, the dispense drawer clutch 45 is deactivated and the stepper motor 32 is stopped at block 268. After the patient has taken the dispensed medication, the dispense drawer is closed by pressing the dispense button 29 again. Therefore, decision point 270 determines if the dispense button 29 has been pressed. If it has not, the wait block 234 is executed. If it has, the stepper motor 32 is activated in the reverse direction and drawer clutch 45 is engaged at block 272. Decision point 274 determines if the dispense drawer has been fully closed. When it has, block 276 increments the compliance data array taken(i) for each medication dispensed. The process then continues at decision point 278.

Figure 9F:
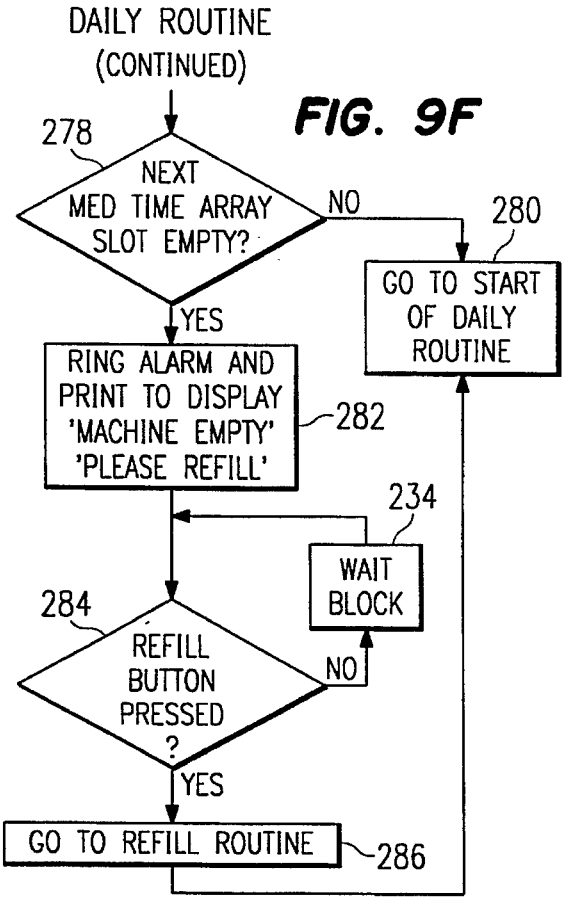

Referring now to FIG. 9F, decision point 278 determines if the next (med #,time) array slot is empty (i.e. the pill dispenser needs to be refilled). If it is not, then block 280 indicates that the process returns to the start of the daily routine (i.e. decision point 228 of FIG. 9C). If the pill dispenser 10 does need to be refilled, block 282 rings an alarm and prints a warning to the display 28 that the machine is empty and must be refilled. Decision point 284 then determines if the refill button has been pressed by the care giver. If not, the wait block 234 is executed. If the refill button has been pressed, block 286 directs the process to the refill routine (i.e. block 330 of FIG. 9I). After the refill routine is complete, the process proceeds to block 280, which returns to the start of the daily routine (i.e. decision point 228 of FIG. 9C).

Figure 9G:
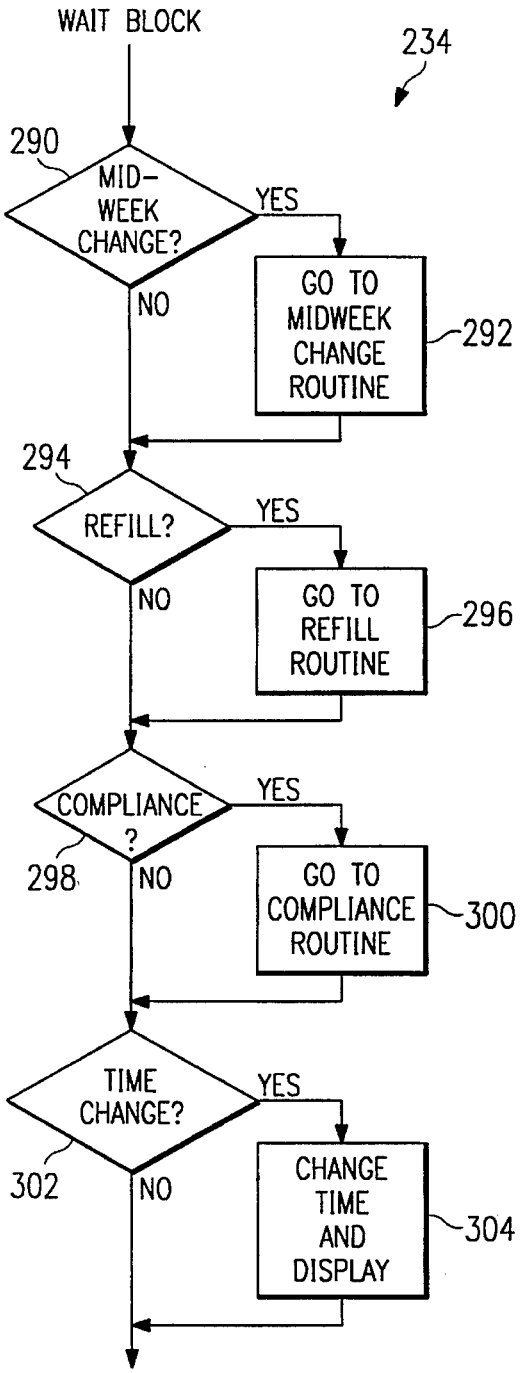

Referring now to FIG. 9G, the Wait Block 234 begins with decision point a which checks to see if the care giver has commanded a mid-week change by input from the keyboard 24. If so, the midweek change routine at block 292 is executed (see FIG. 9H). If there has been no command for a midweek change, decision point 294 determines if the care giver has signalled that they wish to refill the pill dispenser 10. If so, the refill routine at block 296 is executed (see FIG. 9I). If there has been no command for a refill, the process moves to decision point 298 which determines if compliance data has been requested by input from the keyboard 24. If so, the compliance routine at block 300 is executed (see FIG. 9J). If there has been no request for compliance data at decision point 298, the process continues at decision point 302 which determines if the current time input from the real time clock 152 is different than the current time displayed on the LCD display 28. Normally, the time displayed on LCD display 28 will be only to the nearest minute, so decision point 302 checks to see if the current time from real time clock 152 is at least one minute later than the displayed time. If so, then the display is updated at block 304. If decision point 302 determines that the displayed time does not need to be updated, the wait block 234 is exited.

Figure 9J:
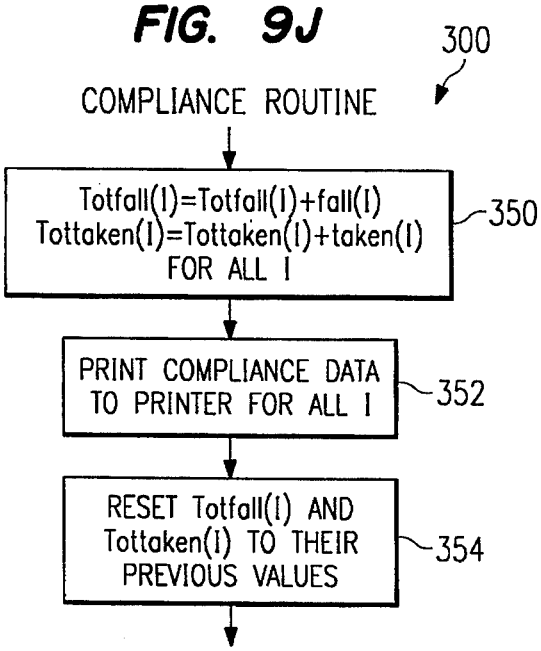
Figure 9H:
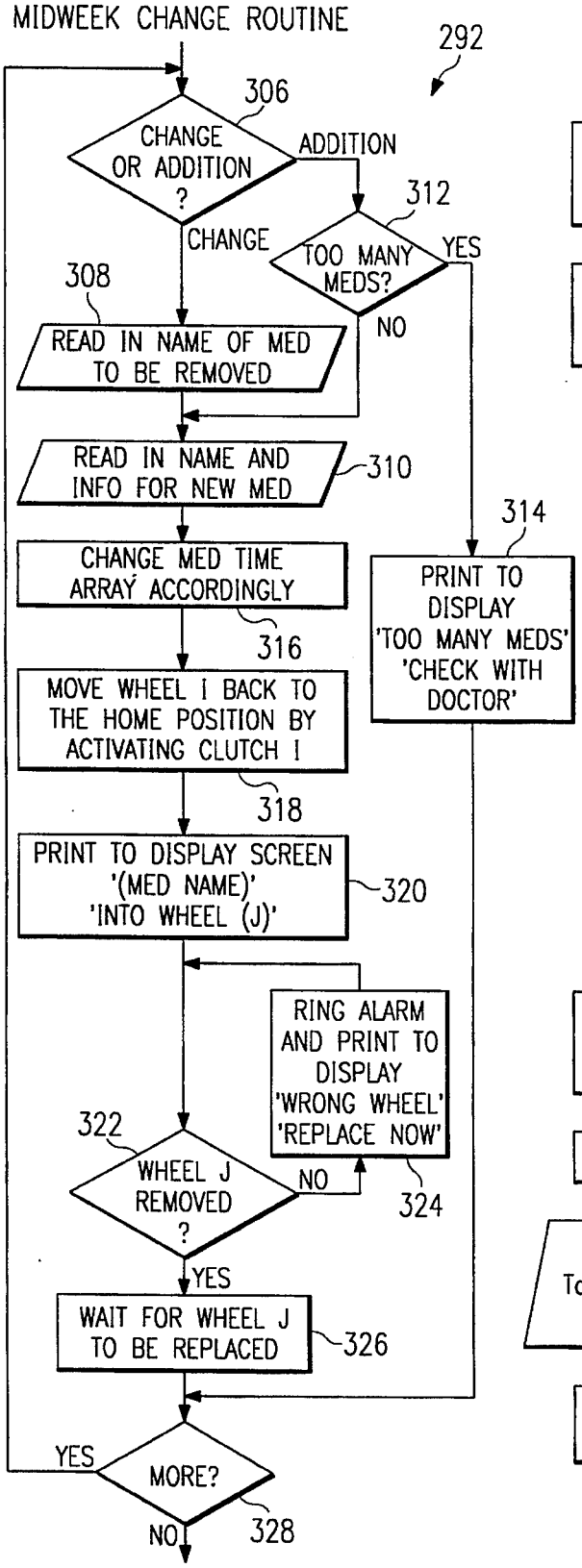

Referring now to FIG. 9H, the midweek change routine 292 is illustrated. The care giver will request the midweek change routine from the keyboard 24 whenever there has been a change or an addition to the patient's prescription schedule. In the case of a change, the physician has replaced one medication by a different medication in the patient's prescription schedule. In the case of an addition, the physician has made no alteration of the patient's current medication, but has added an additional medication. Therefore, decision point 306 prompts the care giver to input whether a change or an addition is required.

If the care giver has signalled that a change is required, block 308 asks the care giver to input the name of the medication to be removed. Block 310 then asks the care giver to input the name of the new medication and the new medication dispensing times. Block 316 then changes the (med #,time) array to incorporate the new information. The array is then resorted into time order and a new maximum frequency Z(j) is calculated. Next, the cartridge(j) which corresponds to the medication which is being changed is moved back to its home position in block 318. Block 320 then instructs the care giver to load the new medication into the cartridge(j). Decision point 322 checks to make sure that cartridge(j) was removed. If another cartridge was removed instead, block 324 sounds an alarm and instructs the care giver to replace the removed cartridge. Once the correct cartridge(j) has been removed, the process pauses at block 326 to wait for the cartridge (j) to be replaced. Once the cartridge(j) has been replaced, decision point 328 asks the care giver if more changes or additions are required. If so, the process returns to decision point 306. If not, the midweek change routine is exited.

If the care giver has signalled that an addition is required at decision point 306 rather than a change, the process continues at decision point 312 which determines if there the maximum number of medications are already loaded into the pill dispenser 10. If so, the warning "check with doctor" is displayed on LCD display 28 and the care giver is then given a chance to try again at decision point 328. If the maximum number of medications has not already been loaded into the pill dispenser 10, the process resumes at block 310 as described above.

Figure 9I:
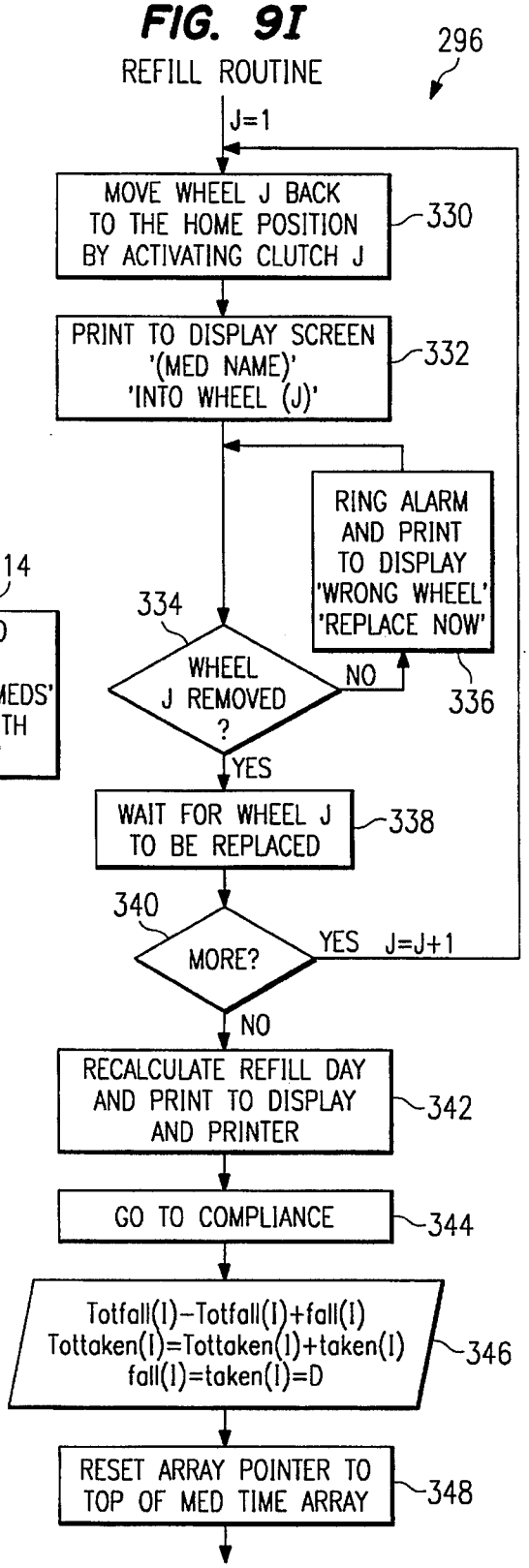

Referring now to FIG. 9I, the steps of the refill routine 296 are detailed. When this routine is executed, all of the cartridges(j) will be refilled with medication, so the variable j is initially set to be j=1. Then block 330 moves cartridge(j) back to the home position and block 332 displays a message to the care giver on LCD display 28 to refill Med(j) into cartridge(j). Decision point 334 then checks to see if cartridge(j) was removed. If the wrong cartridge was removed by the care giver, block 336 sounds an alarm and displays a message to replace the cartridge and the process returns to decision point 334. If the correct cartridge(j) was removed by the care giver, the process is paused at block 338 until the cartridge(j) is replaced. Decision point 340 then determines if there are more cartridges to be refilled. If there are, the variable j is incremented and the process returns to block 330.

Once all of the medications have been refilled, block 342 recalculates the next refill day and displays this information on both the LCD display 28 and the printer 164. Block 342 also prints the entire prescription schedule to the printer 164 so that the patient will have a record of what medication he is currently taking. Block 344 then calls the compliance subroutine (see FIG. 9J). After the compliance subroutine has printed the current compliance data, the arrays taken(i) and fail(i) will contain the information concerning the quantity of each medication taken and the quantity of each medication not taken, respectively, for each medication since the last refill. Block 346 then updates the cumulative compliance arrays tottaken(i) and totfail(i) with the new compliance data, and then zeroes the compliance data arrays taken(i) and fail(i). The array pointer is then reset in block 348 to the top of the (med #,time) array and the refill routine is exited.

Referring now to FIG. 9J, the compliance routine is illustrated in greater detail. The compliance routine is used to calculate the current compliance data for all the medications at block 350. This compliance data is printed to the printer 164 at block 352 and the compliance data arrays totfail(i) and tottaken(i) are reset at block 354 to the values they had before the compliance routine was started. Therefore, the compliance routine is used only to print out the patient's current compliance data and the execution of this compliance routine does not permanently change any of the information in any of the data arrays.

While the preferred embodiment of the invention has been illustrated and described, those skilled in the art can easily make changes without departing from the spirit and scope of the invention.

I claim:

1. An automatic pill dispenser for dispensing sequential pills from selected at least one cartridge according to a predetermined prescription schedule, comprising:

a housing adapted for removably holding at least one cartridge having pill compartments, the housing having means for collecting pills that are distributed from any cartridge;

at least one cartridge having pill holding compartments removably mounted in the housing, each having a pill dispensing opening adapted for selective positioning in communication with an opening of successive compartments of the cartridges in response to movement of the cartridge, to define a dispensing position;

a drive means for independently moving any given number of the at least one cartridge to the dispensing position so that the pill dispensing opening is in communication with the pill collecting means;

control means for operating the drive means in accordance with the predetermined prescription schedule so that the correct combination of pills become available at intervals according to the schedule; and dispenser means mounted in the housing, said dispenser means having a member being movable to close said pill dispensing openings and openable to release pills from all of said pill dispensing openings into said collecting means.

2. The pill dispenser of claim 1 wherein said compartments are included in a rotatable portion movable by the drive means by rotating to the dispensing position wherein an opening of a compartment is at the dispensing position.

3. The pill dispenser of claim 2 wherein the rotatable portion has compartments around the periphery and a removable cover member to enclose pills in the compartments.

4. The pill dispenser of claim 1 wherein the dispenser member includes sweeping means for moving through each compartment when it is located at the pill dispensing opening, to remove the pills contained therein.

5. The pill dispenser of claim 4 wherein the sweeping means comprises a wire attached to said dispenser member and movable with it to physically sweep through said compartment as said dispenser member is moved.

6. An automatic pill dispenser for dispensing sequential pills from selected ones of a plurality of cartridges according to a predetermined prescription schedule, comprising:

a housing adapted for removably holding a plurality of cartridges having pill compartments, the housing having means for collecting pills that are distributed from any cartridge;

a plurality of cartridges having pill holding compartments removably mounted in the housing, each having a pill dispensing opening adapted for selective positioning in communication with an opening of successive compartments of the cartridges in response to movement of the cartridge, to define a dispensing position;

a drive means including a plurality of clutch means which are individually engageable for independently moving any given number of the cartridges to the dispensing position so that the pill dispensing opening is in communication with the pill collecting means, wherein said compartments are included in a rotatable portion movable by the clutch means by rotating to the dispensing position wherein an opening of a compartment is at the dispensing position; and control means for operating the drive means, including the clutch means, in accordance with the predetermined prescription schedule so that the correct combination of pills become available at intervals according to the schedule.

7. The pill dispenser of claim 6 wherein the drive means includes complementary gear means on the rotatable portion of the cartridges and the clutch means, which cooperate to turn the rotatable portion of the cartridges.

8. The pill dispenser of claim 7 wherein the drive means includes a common shaft on which said clutch means are mounted for rotation, which is drivingly connected to a motor operated by the control means.

9. The pill dispenser of claim 8 wherein the housing includes sensing means connected to the control means for sensing the movement of the rotatable portion of the cartridges which enables the control means to advance the cartridges one compartment at a time.

10. The pill dispenser of claim 9 wherein the sensing means comprise photodetectors mounted in the housing, directed toward the rotatable portion of the cartridges, which signal the control means when said compartments are aligned with pill dispensing openings.

11. An automatic pill dispenser for dispensing sequential pills from selected ones of a plurality of cartridges according to a predetermined prescription schedule, comprising:

a housing having an opening therein and a plurality of cartridges having pill compartments about their periphery, each compartment having an open end at its periphery for moving past a wall opening;

said compartments being closed by a wall having an opening in communication with the opening of the housing and one of said compartments, said cartridges being individually rotatable to successive dispensing positions wherein successive compartments are open through the opening in said wall;

a patient activated dispenser which closes said wall openings unless a patient activates the dispenser to release pills from compartments aligned with said wall openings, said walls retaining unreleased pills after a given cartridge has been rotated to a successive dispensing position;

drive means for moving the cartridges to successive dispensing positions; and control means for operating the drive means in accordance with the predetermined prescription schedule so that the correct combination of pills becomes available for release at intervals according to the schedule.

12. The pill dispenser of claim 11 wherein the control means includes a microprocessor for operating an algorithm which allows prescription schedule input data to be received, stored and processed, the algorithm determining in combination with a clock means when to activate the drive means.

13. The pill dispenser of claim 11 wherein the control means includes annunciator means for signaling the patient that a dispense time has arrived.

14. The pill dispenser of claim 11 further including sensing means associated with each cartridge in the housing, the sensing means providing signals to the control means which enable the control means to position the cartridges at successive dispensing positions.

15. The pill dispenser of claim 11 wherein the control means includes means for determining that a cartridge is empty, signaling for refilling of the cartridge, and ceasing to dispense until the cartridge is refilled.

16. The pill dispenser of claim 11 wherein the control means includes compliance means for recording compliance data comprising the number of dispensing opportunities and the number of dispensing occurrences for each medication, the control means further including means for retrieving the compliance data in readable form.

17. The pill dispenser of claim 11 wherein the housing opening opens into a retractable drawer which may be extended in response to a dispensing button operable by the patient for a predetermined time interval after a dispensing time has arrived, whereupon the drawer is retracted by the control means and is not re-extendable until the next dispensing time has arrived.

18. In an automatic pill dispensing apparatus having a housing with an opening for receiving pills from successive pill compartments, at least one cartridge having successive pill compartments each having a pill dispensing opening, and drive means for rotating said pill compartments in timed sequence to successive pill dispensing positions in response to a control means whereby successive pill dispensing openings of said pill compartments are positioned in pill dispensing communication with said opening in the housing to be accessed by a consumer, the improvement comprising:

sweeping means mounted on the housing, said sweeping means having a portion positionable within said cartridge and movable through each of said successive pill compartments when they are positioned in pill dispensing position with the pill dispensing opening of a compartment in communication with said opening for receiving pills from successive compartments in said housing, to aid in removing and dispensing pills from said pill compartments.

19. The automatic pill dispensing apparatus of claim 18 wherein said housing contains spaced apart wall means for separating said at least one cartridge from another of said cartridges, said wall means having a hollow space to accommodate said sweeping means.

20. The automatic pill dispensing apparatus of claim 18 wherein said pill compartments have an opposite opening opposite said pill dispensing opening small enough to prevent pills from escaping, a portion of said sweeping means passing through said opposite opening of the pill compartments in order to dislodge stuck pills.

21. The automatic pill dispensing apparatus of claim 20 wherein the sweeping means is activated by a dispenser means which is controlled to uncover said pill dispensing openings when it is time to dispense one or more pills from said compartments.

22. The dispenser of claim 21 wherein the sweeping means comprises a wire attached to said dispenser means and extending to move through said compartment as said dispenser member is moved.

* * * * *

Disclaimer 5,472,113—Thomas J. Shaw, Little Elm, Tex. AUTOMATIC PILL DISPENSING APPARATUS. Patent dated Dec. 5, 1995. Disclaimer filed April 6, 1998, by the inventor.

The term of this patent shall not extend beyond the expiration date of Pat. No. 5,176,285.

*(Official Gazette,* October 20, 1998)